US009844235B2

(12) United States Patent
Asnis et al.

(10) Patent No.: US 9,844,235 B2
(45) Date of Patent: Dec. 19, 2017

(54) ATHLETIC GARMENT WITH INTEGRATED HANGING POCKET

(71) Applicant: SPECIALIZED BICYCLE COMPONENTS, INC., Morgan Hill, CA (US)

(72) Inventors: Anna Asnis, San Jose, CA (US); Jason Israel, Santa Cruz, CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 696 days.

(21) Appl. No.: 13/802,245

(22) Filed: Mar. 13, 2013

(65) Prior Publication Data

US 2014/0259296 A1 Sep. 18, 2014

(51) Int. Cl.
*A41D 27/20* (2006.01)
*A41D 13/00* (2006.01)
(Continued)

(52) U.S. Cl.
CPC ..... *A41D 13/0012* (2013.01); *A41D 1/002* (2013.01); *A41D 1/04* (2013.01); *A41D 27/20* (2013.01); *A41F 1/002* (2013.01); *A41D 2200/10* (2013.01); *A41D 2400/38* (2013.01); *A41D 2400/46* (2013.01); *A41D 2600/104* (2013.01)

(58) Field of Classification Search
CPC .... A41D 13/0012; A41D 27/20; A41D 1/002; A41D 27/205; A41D 2600/104; A54F 2003/144
USPC ..... 2/69.5, 94, 102, 247, 250, 253
See application file for complete search history.

(56) References Cited

U.S. PATENT DOCUMENTS 367,996 A * 8/1887 Nathan ..... A45F 5/02 150/132
1,905,235 A * 4/1933 Mandelert ..... A41D 27/20 2/94

(Continued)

FOREIGN PATENT DOCUMENTS

DE 3409889 A1 * 1/1985 ..... A41D 3/04
DE 10-2006-031-162 1/2007

(Continued)

OTHER PUBLICATIONS

"Sombrio Smuggle Bib Liner Cycling Shorts Men's Size Large". Sombrio. URL: "https://www.terapeak.com/worth/new-sombrio-smuggle-bib-liner-cycling-shorts-men-s-size-large-black-19902m/291622529859/" Accessed Apr. 26, 2017. Published/Indexed (Google.com) as of Jan. 5, 2012.*

(Continued)

*Primary Examiner* — Jameson Collier
(74) *Attorney, Agent, or Firm* — Knobbe Martens Olson & Bear, LLP

(57) ABSTRACT

One non-limiting embodiment of the present invention includes an athletic garment including a garment configured to snugly fit a torso wherein the garment has a front portion and a rear portion. The athletic garment further includes a pocket secured to the rear portion of the garment providing a pocket for containing items therein. The pocket includes a secured portion and a hanging portion wherein the secured portion is secured to the garment and the hanging portion is not secured to the garment.

11 Claims, 5 Drawing Sheets

(51) Int. Cl.

| | |
|---|---|
| ***A41D 1/00*** | (2006.01) |
| ***A41D 1/04*** | (2006.01) |
| ***A41F 1/00*** | (2006.01) |

(56) References Cited

U.S. PATENT DOCUMENTS

| | | | | | |
|---|---|---|---|---|---|
| 2,079,220 | A | | 5/1937 | Mahoney | |
| 2,304,235 | A | * | 12/1942 | Boots | A61F 5/56 116/1 |
| 2,508,190 | A | * | 5/1950 | Previdi | A45C 1/04 2/253 |
| 2,558,382 | A | * | 6/1951 | Previdi | A63B 47/001 2/250 |
| 3,320,620 | A | * | 5/1967 | Weidler | A41D 13/0012 2/250 |
| 4,079,871 | A | * | 3/1978 | Sica | A63B 47/001 2/247 |
| 4,404,687 | A | | 9/1983 | Hager | |
| 4,502,154 | A | * | 3/1985 | Itoi | A41D 3/00 2/108 |
| 4,723,695 | A | * | 2/1988 | Farber | A01K 77/00 2/94 |
| 4,845,784 | A | * | 7/1989 | Shirinian | A41D 27/20 2/253 |
| 5,265,782 | A | * | 11/1993 | McNamara | A41D 13/12 2/108 |
| 5,687,896 | A | * | 11/1997 | Clift | A45F 5/00 224/587 |
| 5,724,679 | A | * | 3/1998 | Hans | A41D 27/20 2/228 |
| 5,913,409 | A | | 6/1999 | Test | |
| 5,987,644 | A | | 11/1999 | Mengato | |
| 6,298,485 | B1 | | 10/2001 | Heller | |
| 6,993,940 | B2 | * | 2/2006 | Rabinowicz | A41D 13/0015 2/250 |
| 7,219,373 | B2 | * | 5/2007 | McNamara | A41D 13/04 2/247 |
| 7,424,962 | B2 | * | 9/2008 | Mooney | A45F 5/021 2/220 |
| D612,583 | S | | 3/2010 | Marois et al. | |
| D623,830 | S | | 9/2010 | Marois et al. | |
| 8,032,948 | B2 | | 10/2011 | Anderson | |
| 8,087,095 | B2 | | 1/2012 | Maier | |
| 8,312,568 | B2 | | 11/2012 | Marois et al. | |
| 2005/0076422 | A1 | * | 4/2005 | Aldridge | A41D 13/00 2/455 |
| 2007/0000030 | A1 | * | 1/2007 | Toomey | A41D 27/20 2/247 |
| 2007/0271671 | A1 | * | 11/2007 | Okajima | A41D 1/04 2/69 |
| 2007/0294801 | A1 | | 12/2007 | Furgerson et al. | |
| 2008/0047046 | A1 | * | 2/2008 | Maier | A41D 1/04 2/102 |
| 2008/0263742 | A1 | * | 10/2008 | Vaughn | A41D 1/08 2/69 |
| 2011/0307991 | A1 | * | 12/2011 | Writt | A41D 27/205 2/69 |
| 2012/0030864 | A1 | | 2/2012 | Marois et al. | |

FOREIGN PATENT DOCUMENTS

| | | | | | |
|---|---|---|---|---|---|
| FR | 1373791 | A | * | 10/1964 | A41D 27/20 |
| FR | 1565553 | A | * | 5/1969 | A41D 27/20 |
| FR | 2476453 | A1 | * | 8/1981 | A41D 13/02 |

OTHER PUBLICATIONS

Office Action recieved in co-pending German Application No. 102014002754.6, dated Nov. 13, 2014 in 6 pages with English translation.

* cited by examiner

ATHLETIC GARMENT WITH INTEGRATED HANGING POCKET

BACKGROUND OF THE INVENTION

Field of the Invention

The present invention relates to athletic garments and, in particular, athletic garments having an integrated hanging pocket.

Description of the Related Art

Many bicycle riders wear tight fitting clothing which can stretch and flex. The clothing may be a one piece bib liner style athletic garment or the clothing may comprise separate garments, a jersey and a short for example. The tight fitting garments sometimes include a pocket in which the rider can store tools, food, water, and extra clothing. Often, these pockets are located on the back of the garment near the rider's lower back.

Some bicycle riders, mountain bike riders in particular, prefer to wear loose style clothing in addition to a tight fitting garment. These riders may wear a one piece athletic garment underneath a pair of loose fitting shorts for example. The tight fitting garment may also incorporate a pad for seat comfort.

SUMMARY OF THE INVENTION

The systems, methods and devices described herein have innovative aspects, no single one of which is indispensable or solely responsible for their desirable attributes. Without limiting the scope of the claims, some of the advantageous features will now be summarized.

One aspect of the present invention is the realization that many mountain bikers prefer to ride without backpacks to carry tools, food, water, and extra clothing as backpacks can be heavy and hot to wear. In addition, many mountain bikers who wear loose style clothing prefer not to carry many items in the pockets of their loose fitting shorts as it tends to bounce around inside the pockets, which can be both uncomfortable and distracting. Conventional tight fitting clothing that incorporates pockets into the back of the garment near the rider's lower back (See FIG. 1), tends to force the waistband of the loose fitting shorts downward when the pockets are loaded, preventing the waistband of the pair of loose fitting shorts to sit at its intended location. Thus, there exists need for an improved athletic garment with integrated pockets.

One non-limiting embodiment of the present invention includes an athletic garment comprising a garment configured to snugly fit a torso wherein the garment has a front portion and a rear portion. The athletic garment further comprises a pocket secured to the rear portion of the garment providing a stretchable pocket for containing items therein. The pocket comprises a secured portion and a hanging portion wherein the secured portion is secured to the garment and the hanging portion is not secured to the garment.

Another non-limiting embodiment of the present invention includes a method of manufacturing the invention described herein.

Another non-limiting embodiment of the present invention includes a method of use of the invention described herein.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION OF THE PREFERRED EMBODIMENTS

Figure 2B:
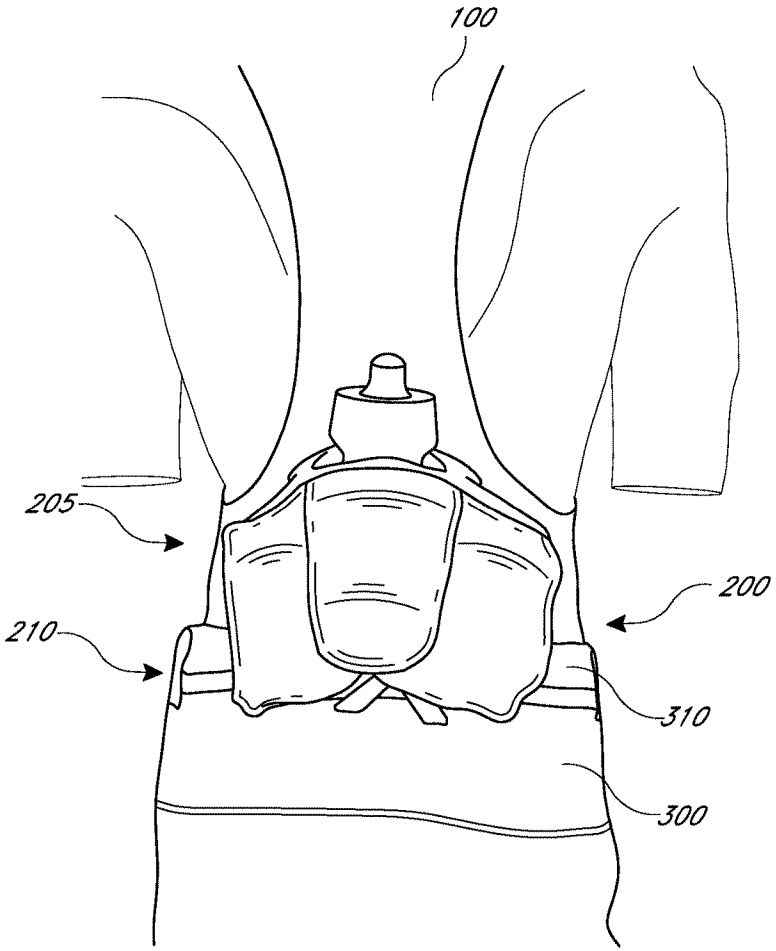
FIG. 2B illustrates a rear view of the athletic garment of FIG. 2A.
Figure 2A:
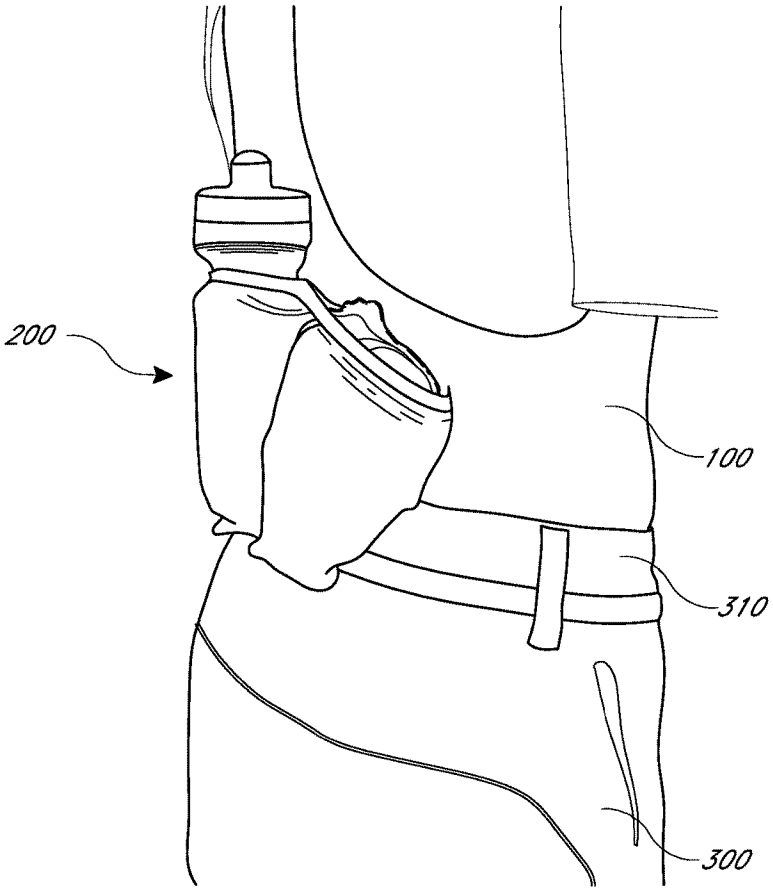
FIG. 2A illustrates a perspective view of the rear of one embodiment of an athletic garment with integrated hanging pocket, wherein the pockets is loaded, including a pair of loose fitting shorts worn over the garment.

FIG. 2A illustrates a perspective view of the rear of one embodiment of an athletic garment 100 with integrated hanging pocket 200, wherein the pocket 200 is loaded, including a pair of loose fitting shorts 300 worn over the garment. FIG. 2B illustrates a rear view of the athletic garment 100 of FIG. 2A. In one embodiment, the athletic garment 100 comprises a stretchable fabric and is constructed to snugly fit the torso of a user. In one embodiment the stretchable fabric may be vented or comprise apertures to keep the user cool. In one embodiment, the athletic garment 100 may comprise a fabric which is not stretchable. In one embodiment the athletic garment 100 may comprise designs, logos, or numbers printed on the garment 100. In one embodiment a user may include a casual exerciser. In one embodiment a user may include an athlete. In another embodiment a user may include a bicyclist, such as a road bicyclist or a mountain biker.

In one embodiment, the athletic garment 100 has a front portion 110 and a rear portion 120. When worn by a user, the front portion 110 is adjacent their chest and stomach while the rear portion 120 is adjacent their back. In one embodiment, the rear portion 120 of the athletic garment 100 includes a pocket 200 near the user's lower back to store items such as food, water, and tools. The location of the pocket 200 allows the user to reach items stored in the pocket 200 without removing the athletic garment 100 by reaching around to their lower back. In one embodiment, the pocket 200 comprises a stretchable fabric forming a stretchable pocket 200 for containing objects therein with a stretch fit. In one embodiment, the pocket 200 may comprise a fabric which is not stretchable. In one embodiment, the pocket 200 may contain object therein without a stretch fit. In one embodiment, the athletic garment 100 may include additional pockets in other locations to hold additional items.

Figure 1:
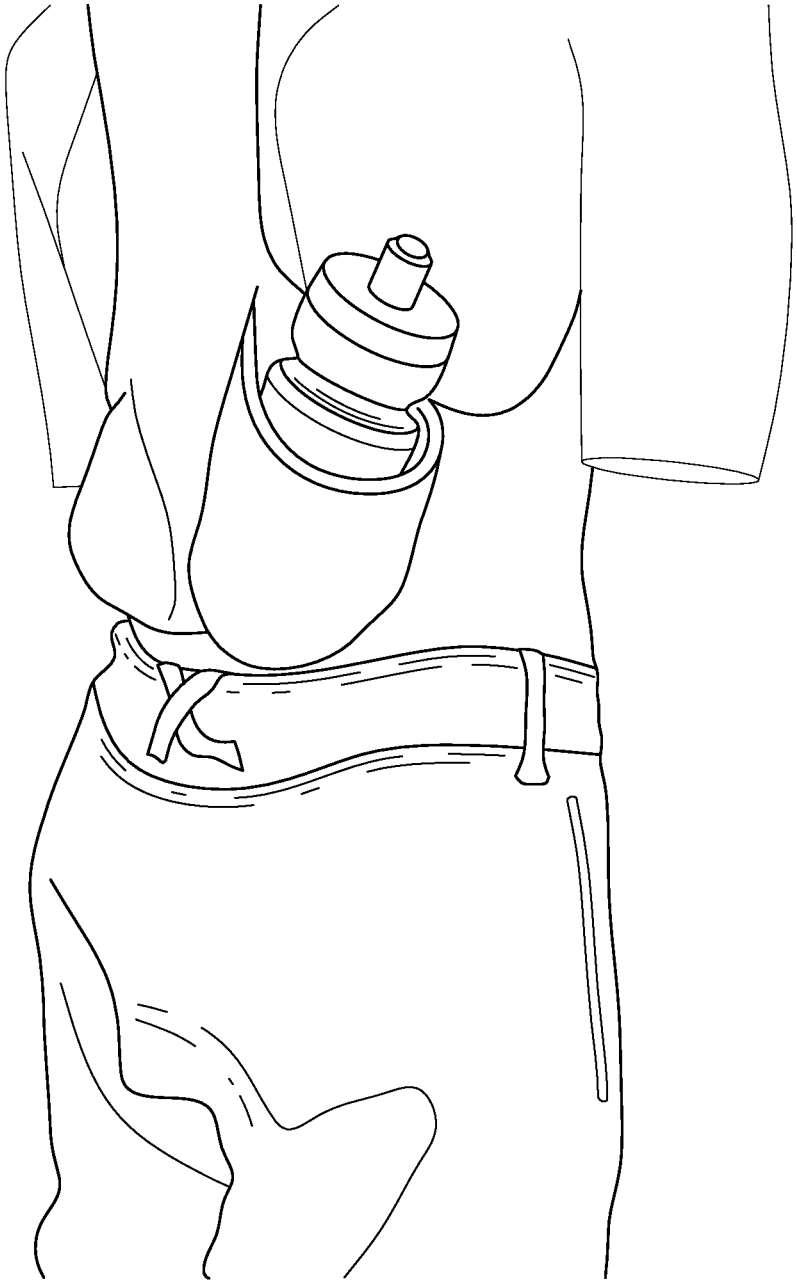
FIG. 1 (PRIOR ART)
FIG. 1 illustrates a perspective view of a conventional athletic garment with fully secured pockets, wherein the pockets are loaded, including a pair of loose fitting shorts worn over the garment.

As illustrated in FIGS. 2A-2B, some users prefer to wear loose style clothing in addition to a tight fitting garment 100. For example, the user may wear a pair of loose fitting shorts 300 over an athletic garment 100. In one embodiment, as illustrated in FIG. 1, the pocket may be fully secured to the athletic garment. In other words, the pocket is secured to the garment along the sides and the bottom of the pocket. Due to the preferred location of the pocket on the user's lower back for ease of user access, the pocket tends to occupy the same space as the natural position for a waistband of a pair of loose fitting shorts. A fully secured pocket tends to force the waistband of the loose fitting shorts downward when the pocket is loaded, preventing the waistband of the pair of loose fitting shorts to sit at its intended location. A loaded pocket refers to a pocket which has items such as food, water, or tools stored within the pocket. The dislodging of the pair of loose fitting shorts by the loaded pocket inhibits the fit and comfort of the loose fitting shorts. The shorts may bunch up or the garment may ride up the user's back due to the force exerted by the waistband of the loose fitting shorts, causing discomfort to the user.

In another embodiment, as illustrated in FIGS. 2A-2B and 3A-3B, the pocket 200 comprises a secured portion 205 and a hanging portion 210. The secured portion 205 comprising a portion of the pocket 200 which is secured to the athletic garment 100 and the hanging portion 210 comprising a portion of the pocket 200 which is not secured to the athletic garment 100. In one embodiment, the secured portion 205 may be secured to the garment 100 with a single use fastener, such as stitching or adhesive. In another embodiment, the secured portion 205 may be secured to the athletic garment 100 in other ways, such as with a readily reusable fastener, such as, for example, snaps, buttons, zippers, hook and loop fasteners such as those sold in connection with the trademark VELCRO®, magnets, etc. The secured portion 205 of the pocket 200 is desirably the portion closer to the head of the user while the hanging portion 210 is closer to the feet of the user. In one embodiment, the secured portion 205 is located above the natural position for a waistband 310 of a pair of loose fitting shorts 300. In one embodiment, at least some of the hanging portion 210 is located at the same height as the natural position for a waistband 310 of a pair of loose fitting shorts 300. FIGS. 2A-2B illustrate a pair of loose fitting shorts 300 worn with the waistband 310 at a natural position on a user. The hanging portion 210 of the pocket 200 allows some of the pocket 200 to overhang the waistband 310 of the loose fitting shorts 300 since there is no connection between the hanging portion 210 of the pocket 200 and the athletic garment 100. As illustrated in FIGS. 2A-2B, the waist band 310 of the loose fitting shorts 300 at its natural location occupies the space between the athletic garment 100 and the hanging portion 210 of the pocket 200. The hanging portion 210 allows the loose fitting shorts 300 and the pocket 200 to occupy the same area near the user's lower back, allowing the loose fitting shorts 300 to sit at their natural position and not be forced downwards by a loaded pocket 200 while the pocket 200 is located in an ideal location for the user to access the contents of the pocket 200.

Figure 3A:
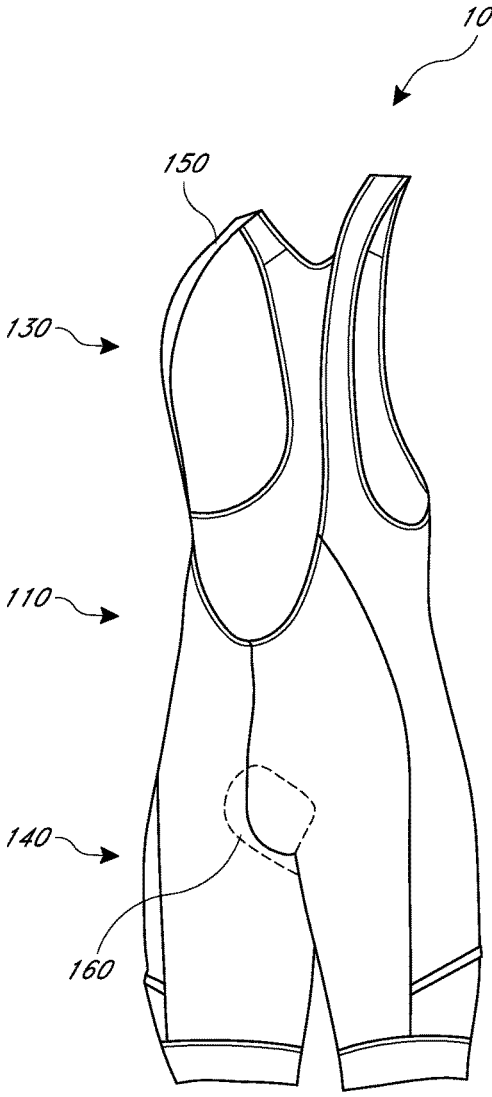
FIG. 3A illustrates a perspective view of the front of one embodiment of an athletic garment with integrated hanging pocket.
Figure 3B:
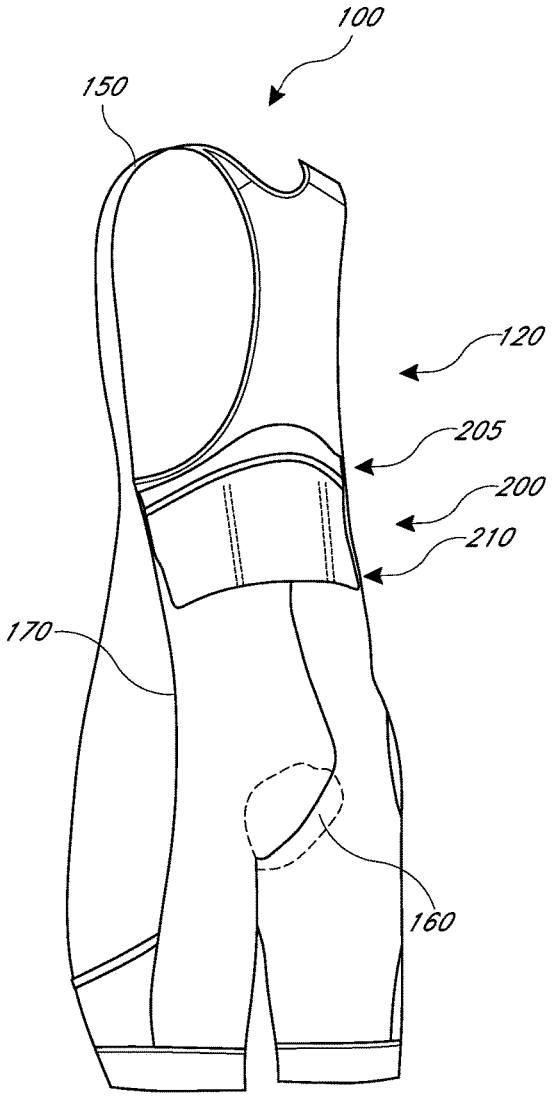
FIG. 3B illustrates a perspective view of the rear of the athletic garment of FIG. 3A.

FIG. 3A illustrates a perspective view of the front of one embodiment of an athletic garment 100 with integrated hanging pocket 200. FIG. 3B illustrates a perspective view of the rear of the athletic garment 100 of FIG. 3A. FIG. 3B also illustrates an unloaded pocket 200. An unloaded pocket 200 refers to an empty pocket 200 which does not contain any items. In one embodiment, as illustrated in FIGS. 3A-3B, the athletic garment 100 comprises an upper body portion 130 as well as a lower body portion 140. In one embodiment, the athletic garment 100 comprises one single piece once manufacturing is complete. In one embodiment, the athletic garment 100 may comprise multiple pieces, an upper body portion 130 and a lower body portion 140 for example. In one embodiment, the athletic garment 100 may only comprise an upper body portion 130. In one embodiment the athletic garment 100 may comprise multiple pieces of fabric secured together. In one embodiment the pieces of fabric may be secured together using stitches. In one embodiment the stitches may be, for example, double stitches, single needle stitches, or flatlock stitches. In one embodiment, the pieces of fabric may be secured together using an adhesive. Materials used in the athletic garment 100 may include, for example, polyester, nylon, and spandex.

In one embodiment, the upper body portion 130 is constructed to snugly fit at least a user's torso. In one embodiment, the upper body portion 130 resembles a jersey. In one embodiment, the upper body portion 130 may be constructed like a shirt which fully encompasses the user's torso and at least a portion of their arms. In one embodiment the upper body portion 130 may include sleeves. In another embodiment the upper body portion 130 may not include sleeves. In one embodiment, the upper body portion 130 may use less material than a shirt-like configuration. In one embodiment, the upper body portion 130 includes a front portion 110 and a rear portion 120. In one embodiment, the front portion 110 and rear portion 120 may be joined by a pair of connecting portions 150, such as shoulder straps which run over the top of the user's shoulders to support the athletic garment 100. In one embodiment, the upper body portion 130 may take on alternative configurations which are known to those skilled in the art.

In one embodiment, the lower body portion 140 is constructed to snugly fit at least a portion of a user's thighs, buttox, and groin. In one embodiment, the lower body portion 140 resembles a pair of shorts. In one embodiment, the lower body portion 140 is joined to the upper body portion 130. In one embodiment, the lower body portion 140 may incorporate portions which are less elastic than other regions in order to retain the athletic garment 100 in its proper location. In one embodiment the lower portion of the lower body portion 140 which surrounds each thigh may comprise a portion which is less elastic than the rest of the garment 100 to more snugly fit the thighs and prevent the thigh portions of the lower body portion 140 from riding up the user's legs. In one embodiment, the less elastic region may comprise a less elastic material. In one embodiment, instead of a portion of material which is less elastic, the athletic garment 100 may incorporate multiple layers of material in order to achieve a portion of the garment 100 which is less elastic than other portions of the athletic garment 100. In one embodiment, the lower body portion 140 incorporates a pad 160 constructed to cushion the user from bicycle seat. In one embodiment, there is no distinct marking or seam on the athletic garment 100 to demarcate a dividing line between the upper body portion 130 and lower body portion 140; the terms are simply used herein to help describe embodiments of the present invention.

Figure 4:
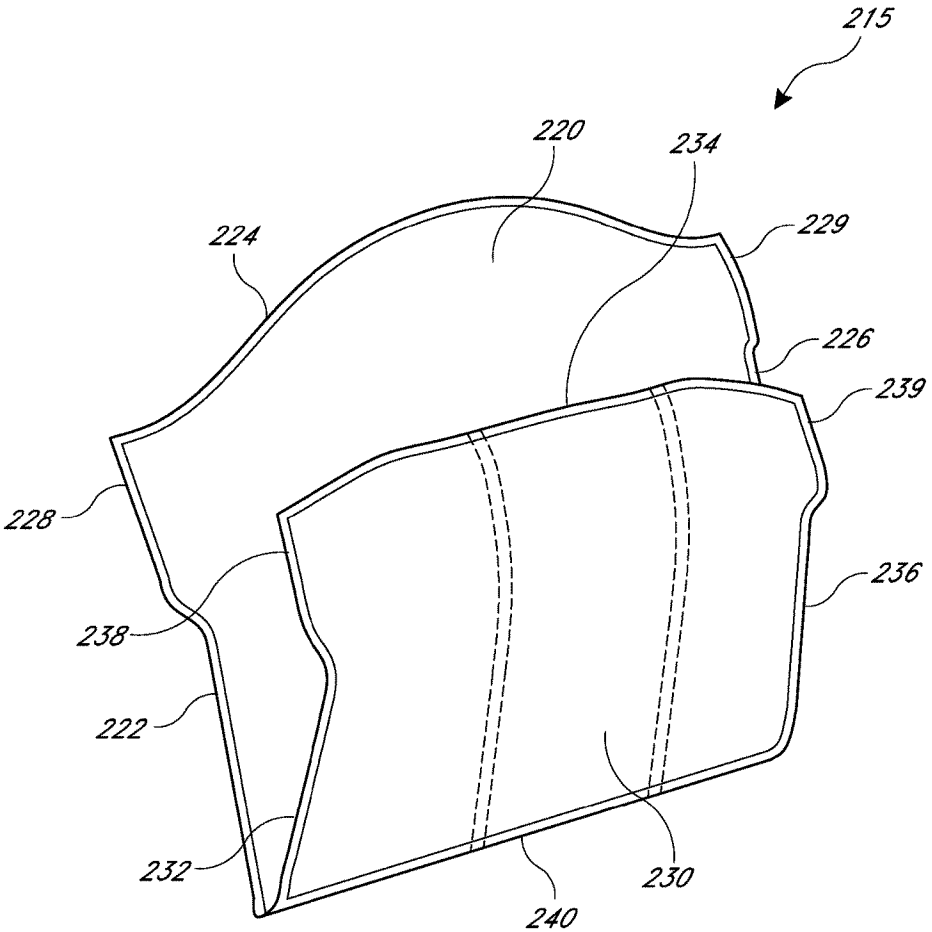
FIG. 4 illustrates a perspective view of one embodiment of a single panel used to form one embodiment of a hanging pocket.

FIG. 4 illustrates a perspective view one embodiment of a single panel 215 used to form one embodiment of a hanging pocket 200. In one embodiment, the pocket 200 comprises a single panel 215 of stretchable material. In one embodiment, the pocket 200 may comprise a single panel 215 of non-stretchable material. The single panel 215 comprises a forward portion 220 and a back portion 230. The forward portion 220 and back portion 230 are separated by a folding axis 240 which is substantially horizontal and approximately parallel to a user's waistline. The single panel 215 is folded along the folding axis 240 so that the folding axis 240 comprises the intersection of the forward portion 220 and the back portion 230 and the forward portion 220 forms the front of the pocket 200 and the back portion 230 forms the back of the pocket 200. In one embodiment, the forward portion 220 comprises a forward upper edge 224, a forward left edge 222, and a forward right edge 226. The back portion 230 comprises a back upper edge 234, a back left edge 232, and a back right edge 236. The folding axis 240 is located along the bottom of both the front portion 110 and the back portion 230. In one embodiment the forward upper edge 224 of the forward portion 220 may be substantially horizontal. In one embodiment the forward upper edge 224 may comprise a contour. In one embodiment the forward upper edge 224 may be taller in the center than each side. In one embodiment the back upper edge 234 of the back portion 230 may be substantially horizontal. In one embodiment the back upper edge 234 may comprise a contour. In one embodiment the back upper edge 234 may be taller in the center than each side.

In one embodiment, the forward portion 220 and back portion 230 of the hanging pocket 200 may not comprise a single panel. The forward portion 220 and back portion 230 may be separate pieces of material. In one embodiment, forward portion 220 comprises a forward bottom edge located along the bottom of the forward portion 220. In on embodiment, the back portion 230 comprises a back bottom edge located along the bottom of the back portion 230. In one embodiment, the forward portion 220 is secured to the back portion 230 along the bottom edge of each portion. In one embodiment, the forward portion 220 is secured to the back portion 230 with stitching along the bottom edge of each portion.

In one embodiment, the forward portion 220 of the single panel 215 may be larger than the back portion 230 so that the forward upper edge 224 extends further up the athletic garment 100 than the back portion 230. In one embodiment, the forward left edge 222 and forward right edge 226 of the forward portion 220 and the back left edge 232 and back right edge 236 of the back portion 230 comprise extensions 228, 229, 238, 239 protruding outwards from each edge. These extensions 228, 229, 238, 239 may be integral to the forward portion 220 and back portion 230 of the pocket 200 or they may be additional material secured to the edges of the pocket 200. In one embodiment the forward left edge 222 of the forward portion 220 is secured to the back left edge 232 of the back portion 230 and the forward right edge 226 of the forward portion 220 is secured to the back right edge 236 of the back portion, forming a pouch. In one embodiment, the forward upper edge 224 and the extensions 228, 229, 238, 239 are secured to the athletic garment 100. In one embodiment the pocket 200 may not comprise extensions 228, 229, 238, 239 and each edge may be secured to the garment 100. In one embodiment the back portion 230 may not comprise extensions 238, 239 and the back left edge 232 and back right edge 236 may be secured to the forward portion 220 and the extensions 228, 229 on the forward portion 220 may be secured to the garment 100. In one embodiment the forward portion 220 may not comprise extensions 228, 229 and the forward left edge 222 and forward right edge 226 may be secured to the back portion 230 and the extensions 238, 239 on the back portion 230 may be secured to the garment 100. In one embodiment, the forward upper edge 224 may be secured to the garment 100.

In one embodiment, the forward portion 220 forms one wall of the pocket 200, wherein the forward portion 220 is the wall closest to the athletic garment 100 and adjacent the user's back. The back portion 230 forms the outside wall of the pocket 200. In one embodiment, the back upper edge 234 of the back portion 230 is not secured to the forward portion 220 or the athletic garment 100, forming a region between the back upper edge 234 and the forward portion 220 where the user can insert items in the pouch formed within the pocket 200.

Figure 5:
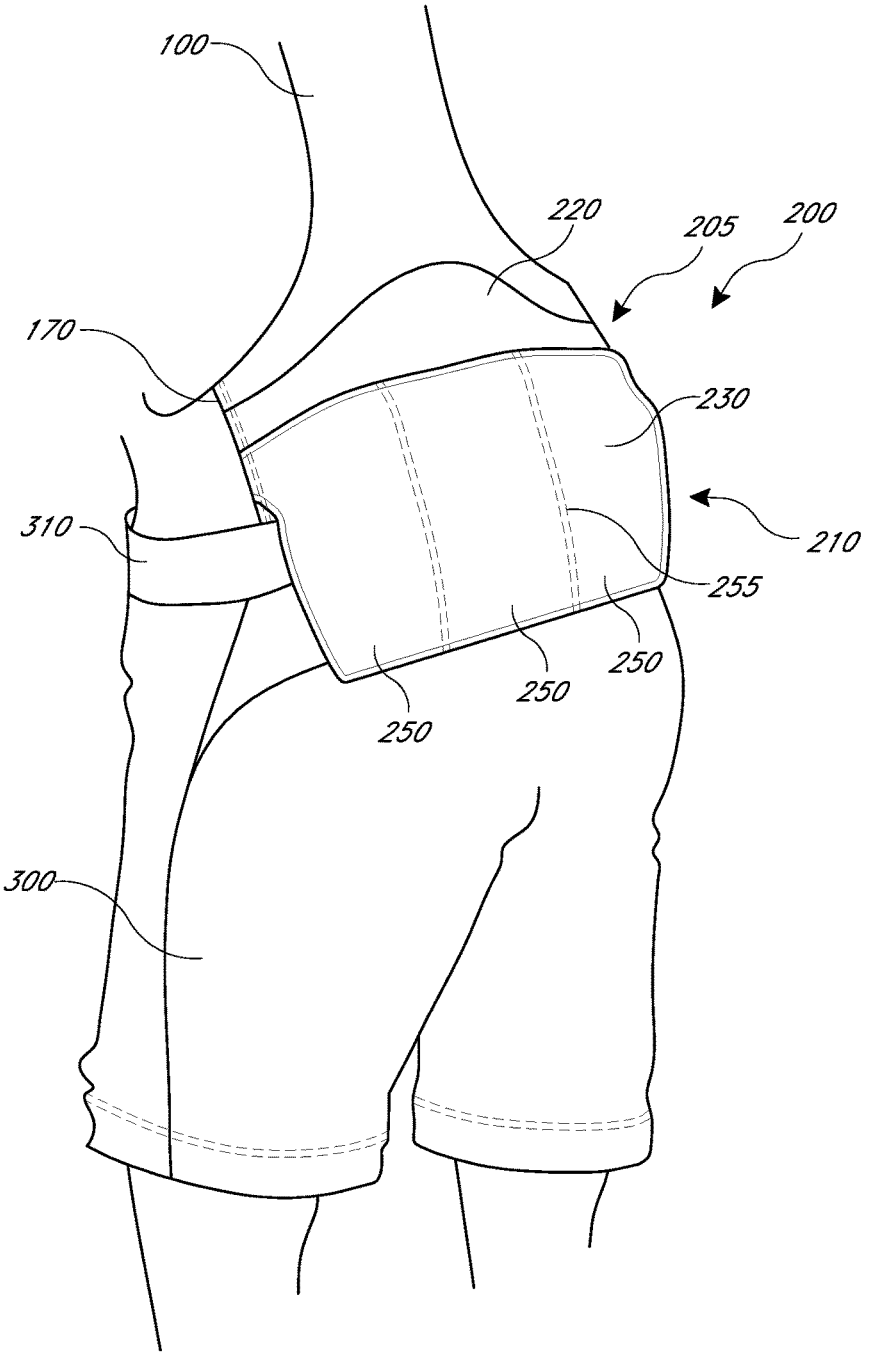
FIG. 5 illustrates a perspective view of the rear of one embodiment of an athletic garment with integrated hanging pocket including a pair of loose fitting shorts worn over the garment.

In one embodiment, the secured portion 205 of the pocket 200 comprises a portion of the pocket 200 which includes the forward upper edge 224 and the extensions 228, 229, 238, 239. In one embodiment, the hanging portion 210 of the pocket 200 comprises the portion of the pocket 200 which is located below the extensions 228, 229, 238, 239. In one embodiment the extensions 228, 229, 238, 239 are constructed to reach the left and right side garment seam 170 as illustrated in FIG. 5. In other embodiments the pocket 200 may not comprise a single panel 215 but may comprise multiple pieces of material secured together. In one embodiment, the forward portion 220 and back portion 230 may comprise separate pieces of material. In one embodiment, the forward portion 220 and the back portion 230 may be the same size. In one embodiment, the back portion 230 may larger than the forward portion 220 and may extend further up the back of the athletic garment 100 than the forward portion 220. In one embodiment, the pocket 200 may not comprise extensions 228, 229, 238, 239. In one embodiment the pocket 200 may be sized to reach the garment seam 170. In one embodiment the pocket 200 may be secured to the athletic garment 100 at an area other than the garment seam 170. In one embodiment, the center of the pocket 200 is substantially aligned with the spine of the user. In other embodiments the pocket 200 may be offset to either side of the spine. In other embodiments, alternative configurations are possible.

FIG. 5 illustrates a perspective view of the rear of one embodiment of an athletic garment 100 with integrated hanging pocket 200 including a pair of loose fitting shorts 300 worn over the garment 100. In one embodiment, the athletic garment 100 comprises garment seam 170 between different pieces of material utilized to construct the athletic garment 100. In one embodiment, the athletic garment 100 comprises a garment seam 170 on each side of the athletic garment 100. In one embodiment the garment seams 170 are substantially vertical or substantially perpendicular to a user's waistline. In one embodiment, in order to minimize the amount of seams in the athletic garment 100, the pocket 200 is secured to the athletic garment 100 along the garment seam 170. In one embodiment, as described above, the extensions 228, 229, 238, 239 of the pocket 200 are secured to the athletic garment 100 along the garment seams 170. The portion of the pocket 200 which is secured to the athletic garment 100 is the secured portion 205. The hanging portion 210, the portion below the secured portion 205, is not secured to the athletic garment 100 and able to hang over a pair of loose fitting shorts 300 located at their natural position as illustrated in FIG. 5.

In one embodiment, the secured portion 205 of the pocket 200 and the hanging portion 210 of the pocket 200 each comprise a portion of the vertical height of the pocket 200. In one embodiment, the secured portion 205 may comprise a larger portion of the vertical height of the pocket 200 than the hanging portion 210 and the ratio of the portion of the vertical height of the secured portion 205 to vertical height of the hanging portion 210 may be approximately, for example, 10 to 1, 9 to 1, 8 to 1, 7 to 1, 6 to 1, 5 to 1, 4 to 1, 3 to 1, 2 to 1, or 1 to 1. In one embodiment, the hanging portion 210 may comprise a larger portion of the vertical height of the pocket 200 than the secured portion 205 and the ratio of portion of the vertical height of the hanging portion 210 to the vertical height of the secured portion 205 may be approximately, for example, 10 to 1, 9 to 1, 8 to 1, 7 to 1, 6 to 1, 5 to 1, 4 to 1, 3 to 1, 2 to 1, or 1 to 1. When defining the portion of the vertical height of the pocket 200 for the secured portion 205 and the hanging portion 210 for the ratios listed above, and only for the ratios listed above, the vertical height of the secured portion 205 shall be the average of the length between the point where the back upper edge 234 intersects the back left edge 232 and the lowest point at which the back left edge 232 is secured to the garment 100 and the length between the point where the back upper edge 234 intersects the back right edge 236 and the lowest point at which the back right edge 236 is secured to the garment 100, and the vertical height of the hanging portion 210 shall be the average of the length between the lowest point at which the back left edge 232 is secured to the garment 100 and the lowest point on the back left edge 232 and the length between the lowest point at which the back right edge 236 is secured to the garment 100 and the lowest point on the back right edge 236. In addition, for defining the ratios above, the length of the back left edge 232 and back right edge 236 shall include any extensions 238, 239 which are part of each back left edge 232 and back right edge 236.

In one embodiment, the pocket 200 may comprise a plurality of sub-pockets 250. In one embodiment the pocket 200 comprises three sub-pocket 250. In, one embodiment, there is a center sub-pocket, a left sub-pocket, and a right sub-pocket. In one embodiment each sub-pocket 250 is approximately the same size. In one embodiment the center sub-pocket may be larger than the other sub-pocket. In one embodiment the center sub-pocket may be smaller than the other sub-pockets 250. In one embodiment the center sub-pocket is substantially aligned with the spine of the user. In another embodiment, the center sub-pocket may be offset to either side of the spine. In one embodiment, each sub-pocket 250 may be separated from the other sub-pockets 250 by sub-pocket stitching 255 securing the back portion 230 of the pocket 200 to the forward portion 220 of the pocket 200. In one embodiment the sub-pocket stitching 255 spans the height of the pocket 200. In one embodiment, the sub-pocket stitching 255 may only span a portion of the height of the pocket 200. In one embodiment the sub-pocket stitching 255 is substantially linear forming substantially vertical sub-pocket 250 which items can be inserted from the top. In one embodiment each sub-pocket stitching 255 separating each sub-pocket 250 may be angled to one side or the other. In one embodiment, each sub-pocket stitching 255 may be substantially horizontal. In one embodiment, the sub-pocket stitching 255 may comprise an alternative method of securing said back portion 230 to said forward portion 220, for example adhesives, hook and loop fasteners such as those sold in connection with the trademark VELCRO®, or buttons may be used.

In one embodiment the sub-pocket 250 may be angled to each side to allow the user easier access to each sub-pocket 250 when reaching around their back. In one embodiment, a sub-pocket 250 may be angled approximately 1 degrees to approximately 45 degrees from vertical. In another embodiment, a sub-pocket 250 may be angled approximately degrees to 30 degrees from vertical. In one embodiment, a sub-pocket 250 may be angled approximately 15 degrees to 25 degrees from vertical. In one embodiment, the center sub-pocket may be substantially vertical while the left sub-pocket is angled to the left and the right sub-pocket is angled to the right.

In one embodiment the pocket 200 may comprise regions which are less elastic than other regions. In one embodiment, the rear upper edge may comprise a region of lower elasticity than the rest of the pocket 200 in order to retain any items stored within the pocket 200. In on embodiment, the back upper edge 234 of the back portion 230 of the pocket 200 comprises a region of lower elasticity. The region of lower elasticity tends to pull tighter against the forward portion 220 of the pocket 200, and in some embodiments, tends to cover at least a portion of an item within the pocket 200 from above, preventing the item stored within the pocket 200 from falling out of the pocket 200 during any movements the user may sustain. In other embodiments, the pocket 200 may include other methods of retaining the items stored within the pocket 200. In some embodiments, the pocket 200 may include means for pulling the back upper edge 234 of the back portion 230 of the pocket 200 towards the front portion 110 or connecting the back upper edge 234 of the back portion 230 of the pocket 200 to the front portion 210. In one embodiment the pocket 200 may include buttons to secure the back upper edge 234 of the back portion 230 to the forward portion 220. In other embodiments the pocket 200 may include a zipper, a plurality of zippers, or magnets to secure the back upper edge 234 of the back portion 230 to the forward portion 220. In another embodiment, the pocket 200 may include a drawstring which runs through at least the back upper edge 234 of the back portion 230 of the pocket 200 which pulls the back upper edge 234 towards the forward portion 220 when the drawstring is pulled tight by the user.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. An athletic garment comprising:

a one-piece bib liner comprising a lower body portion and an upper body portion, said upper body portion having a front portion and a rear portion, and at least one shoulder strap connecting to the front and rear portions of the upper body portion;

an integrated pocket secured to said rear portion of the upper body portion of said one-piece bib liner and positioned on an outer surface of the rear portion of said one-piece bib liner;

wherein said pocket comprises a secured portion and a hanging portion;

wherein said secured portion of said pocket is secured to said one-piece bib liner with a single use fastener and wherein said hanging portion of said pocket is not directly secured to said one-piece bib liner; and wherein said one-piece bib liner is configured to snugly fit a torso.

2. The athletic garment of claim 1, wherein said athletic garment defines a waist between said upper body portion and said lower body portion, wherein said secured portion of said pocket is located above said waist and a portion of said hanging portion of said pocket is located below said waist.

3. The athletic garment of claim 2, wherein said pocket comprises a forward portion and a back portion, wherein said forward portion comprises a forward left edge and a forward right edge and said back portion comprises a back left edge and a back right edge, wherein the back left edge is secured to the forward left edge and the back right edge is secured to the forward right edge, and wherein a portion of said forward left edge and a portion of said forward right edge are secured to said one-piece bib liner.

4. The athletic garment of claim 3, wherein said pocket comprises a plurality of sub-pockets separated by sub-pocket stitching securing said back portion to said forward portion.

5. The athletic garment of claim 4, wherein said pocket comprises a single panel, wherein said single panel is folded along a folding axis, wherein said folding axis comprises an intersection of said forward portion and said back portion.

6. The athletic garment of claim 2, wherein said secured portion of said pocket further comprises extensions on a left edge of said pocket and a right edge of said pocket, where each said extension comprises an integral protrusion extending outwards from said left edge or said right edge of said pocket, wherein each said extension is secured to said one-piece bib liner.

7. The athletic garment of claim 6, wherein said extensions are secured to said one-piece bib liner along seams.

8. The athletic garment of claim 1, wherein said hanging portion comprises a portion of the vertical height of said pocket, wherein said secured portion comprises a portion of the vertical height of said pocket, and wherein the ratio of said vertical height of said hanging portion to said vertical height of said secured portion is at least 1 to 1 and less than or equal to 4 to 1.

9. The athletic garment of claim 1, wherein said hanging portion of said pocket is configured to sit over the top of a waistband of a loose fitting pair of shorts such that said waistband is received intermediate said hanging portion of said pocket and said rear portion of the one-piece bib liner.

10. The athletic garment of claim 1, said lower body portion further comprising a pad positioned to cushion a user from a bicycle seat.

11. An athletic garment comprising:

a one-piece bib liner comprising a lower body portion and an upper body portion, said upper body portion having a front portion and a rear portion, and at least one shoulder strap connecting the front and rear portions of the upper body portion, said lower body portion comprising a pad positioned to cushion a user from a bicycle seat;

an integrated pocket secured to said rear portion of said one-piece bib liner and positioned on an outer surface of the rear portion of said one-piece bib liner;

wherein said pocket comprises a secured portion and a hanging portion;

wherein said secured portion of said pocket is secured to said upper body portion of said one-piece bib liner and said hanging portion of said pocket is not directly secured to said one-piece bib liner;

wherein said one-piece bib liner is configured to snugly fit a torso; and wherein said athletic garment further defines a waist between said upper body portion and said lower body portion, wherein said integrated pocket defines an opening spaced above said waist and a portion of said hanging portion of said pocket is located below said waist.

* * * * *